US006385788B1

(12) United States Patent
Wasielewski

(10) Patent No.: US 6,385,788 B1
(45) Date of Patent: May 14, 2002

(54) WATER DIVERTER/SAVER FOR TOILET TANKS

(76) Inventor: Robert Wasielewski, P.O. Box 15725, Clearwater, FL (US) 33763-5725

( * ) Notice: Subject to any disclaimer, the term of this patent is extended or adjusted under 35 U.S.C. 154(b) by 0 days.

(21) Appl. No.: 09/817,385

(22) Filed: Mar. 27, 2001

Related U.S. Application Data

(60) Provisional application No. 60/261,862, filed on Jan. 17, 2001.

(51) Int. Cl.[7] ..... E03D 1/00

(52) U.S. Cl. ..... 4/415; 4/324; 137/441; 137/883; 137/886

(58) Field of Search ..... 4/415, 324; 137/441, 137/577, 578, 883, 876, 886

(56) References Cited

U.S. PATENT DOCUMENTS

| | | | | | |
|---|---|---|---|---|---|
| 4,980,932 | A | * | 1/1991 | Stemples | 4/415 |
| 5,134,729 | A | * | 8/1992 | Shaw | 4/415 |
| 5,287,565 | A | * | 2/1994 | Auman et al. | 4/415 |

* cited by examiner

*Primary Examiner*—Gregory Huson
*Assistant Examiner*—Kathleen J. Prunner
(74) *Attorney, Agent, or Firm*—Frank A. Lukasik

(57) ABSTRACT

An adjustable diverter device situated in a water tank regulates the water level in the tank. The water enters the device at one end and a flow exits through a first vent into the tank. A second vent is located at the opposite end with an adjustment valve rotatable in the second end. The valve restricts the flow through the second vent and forces a greater amount of water to flow into the water tank.

1 Claim, 4 Drawing Sheets

WATER DIVERTER/SAVER FOR TOILET TANKS

RELATED INVENTION

This application is a continuing application of Provisional Application Serial No. 60/261,862 Filed Jan. 17, 2001.

FIELD OF THE INVENTION

The present invention relates to water saving devices for use in toilet tanks and more particularly to an adjustable diversion device which permits fresh fill water to the toilet tank to be partially redirected to the tank away from the overflow pipe leading to the bowl.

BACKGROUND OF THE INVENTION

Toilets operate generally by providing a sanitary water trap within a bowl having a fitted seat, by which persons may conveniently dispose of human wastes. The water trap acts to exclude sewer gases and to provide a reservoir of clean water for the user. In the act of flushing, the water in the trap is flushed away taking with it whatever is in the water. Once the water refill tank or cistern is empty (having discharged its contents into the bowl), it begins to fill through a valve in the cistern floor. As the cistern fills, water is directed through an overflow pipe which connects to the bowl. The latter is the method by which the water trap is recharged.

In the flushing process described, there is a potential for water waste as the adjustment of water levels, in cisterns and bowls alike, is an inexact system. Some efforts have been made by manufacturers to build small cisterns which take less water to fill. Generally, there is however, an irreducible minimum of water needed to effectively and cleanly evacuate the bowl and the water trap. Efforts to control water wastage by regulating the cistern water level, either by using smaller cisterns, or adding objects to the cistern which displace water and make the float valve close sooner, are limited in their effectiveness.

The present invention addresses the water problem by adjustably limiting the amount of water returned to the bowl and the water trap. The water level in the bowl is generally sufficient as long as there is enough water in the bowl to create the "trap" for sewer gas exclusion and to provide a containment reservoir for human wastes. It is this water level which is addressed by the present invention. By permitting fine adjustment to the bowl/trap refill water, very precise levels can be achieved therein.

SUMMARY OF THE INVENTION

In a preferred embodiment the present invention provides a simple method by which refill water to the toilet bowl/trap can be re-directed so as to provide sufficient water to complete a water/sewer gas trap and to create an adequate reservoir of water for human waste.

It is a further object of the present invention to provide an easily adjustable redirection valve which replaces existing right angled nozzles.

It is a further object of the invention to provide a simple adjustment means using an adjusting screw with a convenient tab handle.

It is a further object of the invention to provide a clip attachment means by which the redirection valve can be affixed to an existing toilet overflow pipe.

A still further object of the invention is to provide a ribbed attachment means whereby an existing refill tube can be affixed to the redirector valve.

It is a further object of the invention to provide two water outlets, one at the inlet end of the redirector valve, to send water to the cistern and one at the outlet end to send water to the toilet bowl.

It is a further object of the invention to cause the adjustment valve to vary the aperture, and thus the volume by which water can exit into the toilet bowl.

It is a further object of the invention to redirect water to the cistern away from the toilet bowl by reason of the adjustable restriction placed upon the main outlet.

DETAILED DESCRIPTION OF THE INVENTION

Figure 1:
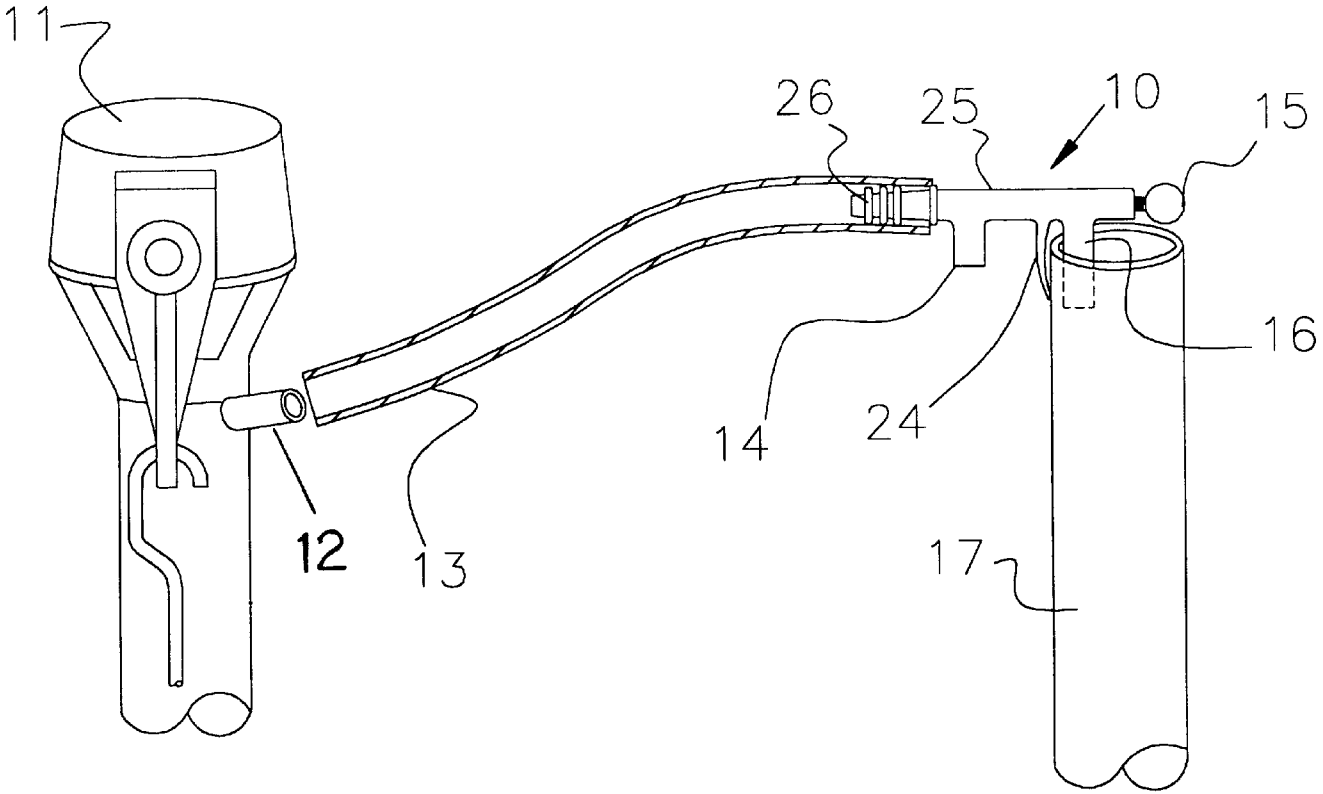
FIG. 1 is an elevational view, partially in section, showing the invention described herein.

Referring now to the drawings, wherein like numerals designate like and corresponding parts throughout the several views, in FIG. 1, the overall invention is designated by the numeral 10. Valve 11 allows water to come in through nipple 12 and out through refill tube 13. Water enters diverter 25, formed as a tube, through ribbed section 26 at a first end and begins to exit at vent 14 disposed near the first end. Clip 24 is formed perpendicular to the diverter tube and secures the device in place on overflow pipe 17. Adjustment valve 15 is rotatably mounted in a second end of diverter tube 25 and regulates water flow from main outlet 16 disposed near the second end. The adjustment valve extends into the diverter tube from the second end to a point forming a junction with the diverter tube at a point just upstream of vent 14*a* such that, when the valve is turned or rotated, the valve adjustably controls the opening and closing of the vent 14*a*.

Figure 2:
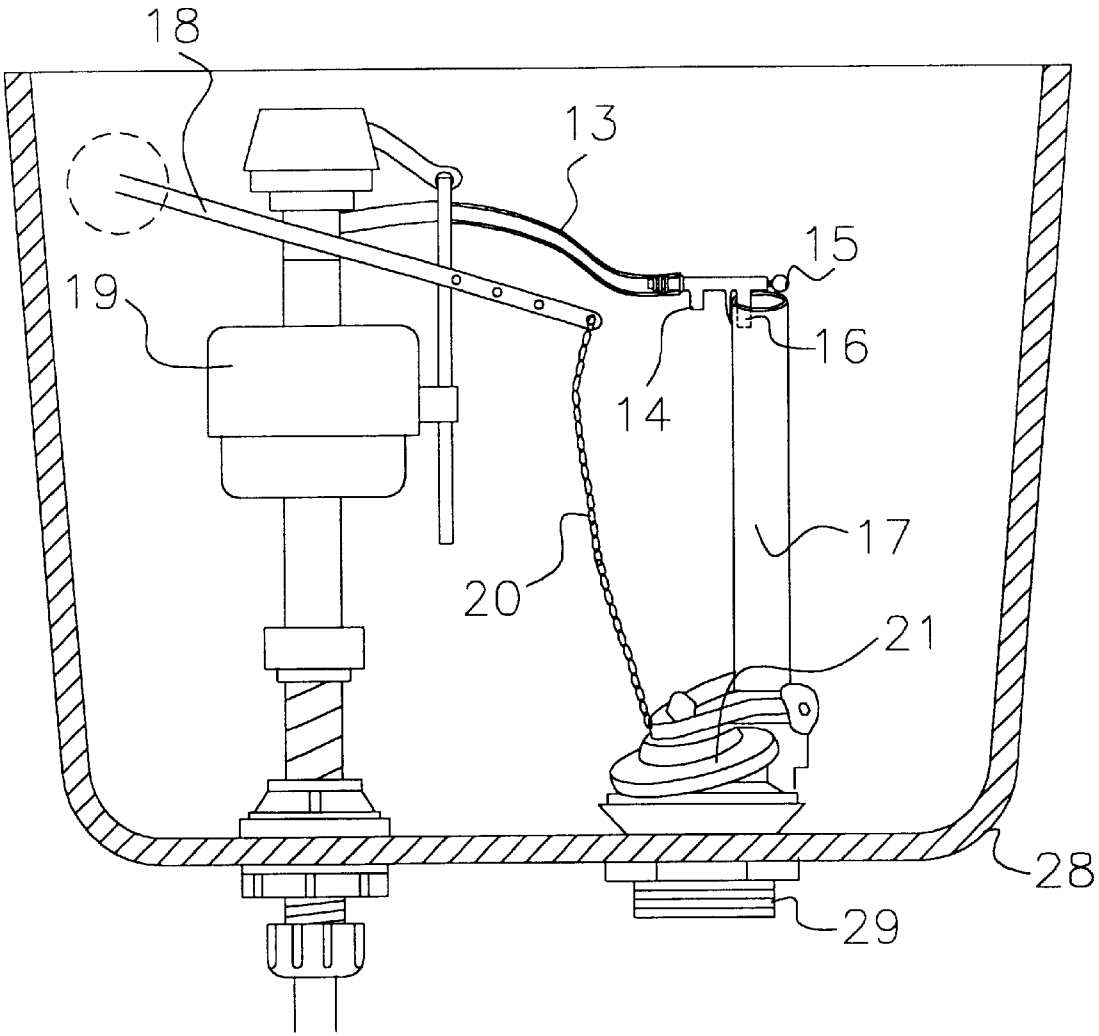
FIG. 2 is an elevational view, partially in section, showing the invention as describe herein, as it is positioned within the toilet cistern.

Referring now to FIG. 2, valve float 19 sets the mean water level in cistern 28. Cistern 28 is flushed through vent 29 and flapper valve 21 which is raised by chain 20 and tank lever 18. The refill procedure continues as described.

Figure 3:
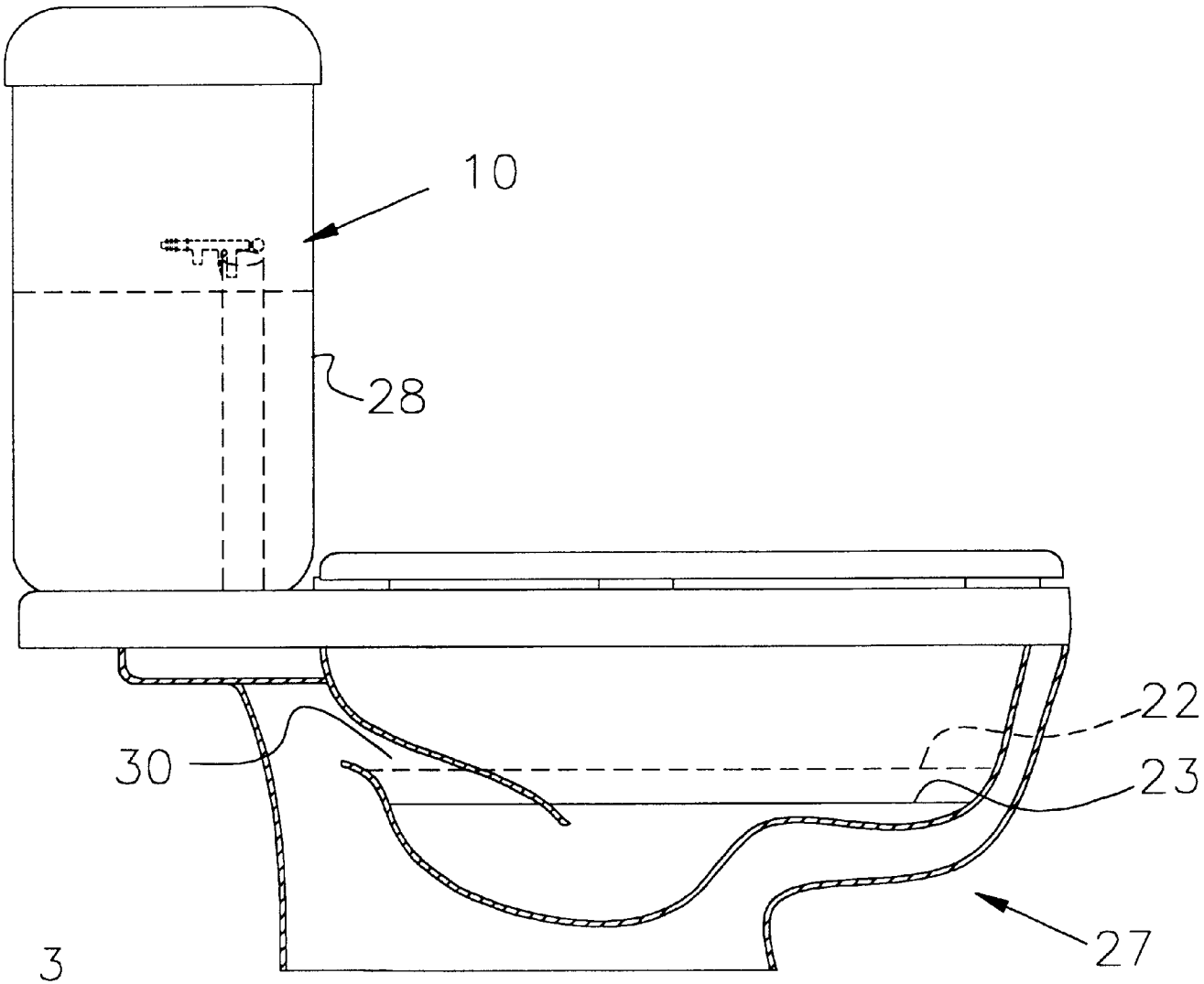
FIG. 3 is an elevational view, partially in section, showing a typical toilet bowl/cistern configuration.

Referring now to FIG. 3, the diverter device 10 of the present invention is situated within tank 28. Water trap 30 in bowl 27 is maintained by water level 22 or adjusted water level 23 as described. Water level 23 is determined by the volume of water which has been permitted to pass into the overflow pipe 17 by adjustment valve 15 (FIGS. 1, 2).

Figure 4:
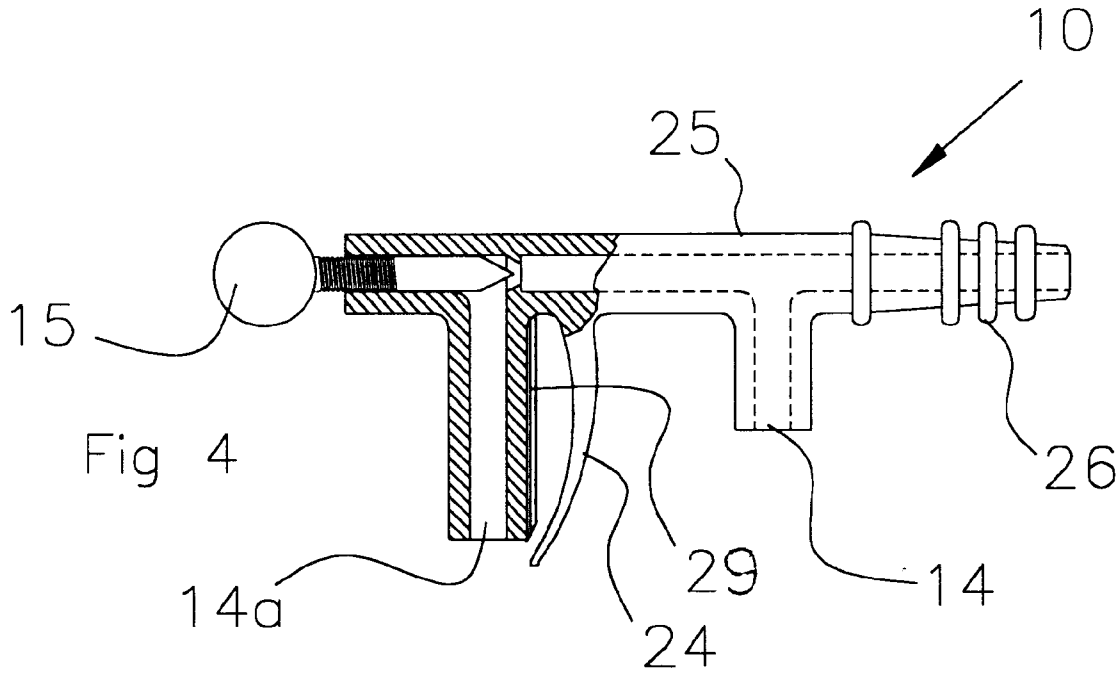
FIG. 4 is an elevational view, partially in section, showing the invention as described herein.
Figure 5:
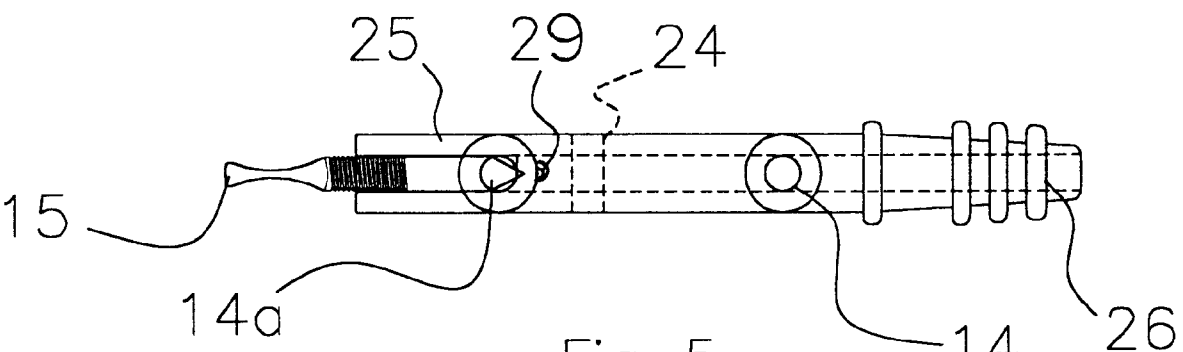
FIG. 5 is a bottom view, partially in section, showing the invention as described herein.

Referring now to FIGS. 4 and 5 wherein vents 14 and 14*a*, which are formed perpendicular to the diverter tube 25, are shown in relation to adjustment valve 15. As can be determined by one skilled in the art, the variation of the position of adjustment valve 15 will regulate the relative flows between vents 14 and 14*a*.

As adjustment valve 15 is closed more and more to restrict water flow from vent 14*a* defined by main outlet 16, water flow/volume will increase through vent 14. The total volume per flush cycle, to flow from vent 14 and 14*a* will be determined by the setting of float valve 19 (FIG. 2). A vertical rib 29 is formed parallel to and along the edge of vent 14*a*, across from the clip 24 to provide a better grip on the overflow pipe 17.

The instant invention is designed to work on new toilets as well as existing toilets even with the refill tube going directly to the bowl filler. To accomplish this, the invention 10 is put at the end of the refill tube 13 and attached to the overflow pipe 17 located in the middle of the toilet cistern 28. The water level should be two inches below the tank overflow pipe 17. If the tank is already at this level, from lowering the level 2 inches, the savings would be one half gallon in the bowl and one quarter gallon from the bowl overflowing over flow level that would normally keep running over until the tank stops filling.

If the tank height is not at the manufacturers set height, 2 inches below the overflow pipe 17, there would be an additional one half to three quarter gallon savings for a total one and a quarter to one and a half gallon. Nationwide, this would be millions of gallons less water used. In many cases, if the tank height was lowered, without the effect of the invention, there would be a very poor flush. The adjustability and control this invention gives the user is phenomenal. From full bowl height, down to 3¼", water can be diverted so precisely that almost any toilet with a tank can benefit from this invention.

What is claimed is:

1. In a flush closet including a toilet bowl and a toilet tank for supplying flush water to the bowl, water being supplied to the tank and bowl after each flush with a refill tube supplying the toilet bowl with water after a flush, the refill tube dispensing water into an overflow pipe in fluid communication with the bowl, the improvement comprising an adjustable diversion device which permits fresh fill water to the toilet bowl to be partially redirected to the tank from the refill tube, said diversion device consisting of:

a diverter tube having a first end and a second end, a ribbed section formed on said first end for attaching to the refill tube, a first vent formed near said first end and opening onto said tank and a second vent formed near said second end and opening into said overflow pipe, each of said vents formed perpendicular to said diverter tube, said second vent having a rib formed parallel to and along said second vent, a clip formed perpendicular to said diverter tube and parallel to and in close association to said second vent for attaching the diverter tube to said overflow pipe, and an adjustment valve rotatably mounted in said second end, said valve extending into said diverter tube from said second end to a point forming a junction with said diverter tube at a point upstream of said second vent such that said valve can be rotated to open or close said second vent, whereby turning said valve adjustably controls the opening of said second vent, thereby reducing the flow of water through said second vent and increasing the flow of water through said first vent into the toilet tank.

* * * * *